US010226087B2

(12) United States Patent
Held

(10) Patent No.: US 10,226,087 B2
(45) Date of Patent: Mar. 12, 2019

(54) MULTIPURPOSE FABRIC MEMENTO

(71) Applicant: Belinda A. Held, Butler, PA (US)

(72) Inventor: Belinda A. Held, Butler, PA (US)

( * ) Notice: Subject to any disclaimer, the term of this patent is extended or adjusted under 35 U.S.C. 154(b) by 458 days.

(21) Appl. No.: 15/066,378

(22) Filed: Mar. 10, 2016

(65) Prior Publication Data

US 2016/0262473 A1 Sep. 15, 2016

Related U.S. Application Data

(60) Provisional application No. 62/133,019, filed on Mar. 13, 2015.

(51) Int. Cl.
*A41D 15/04* (2006.01)
*G09F 17/00* (2006.01)
*G09F 21/02* (2006.01)

(52) U.S. Cl.
CPC ..... *A41D 15/04* (2013.01); *G09F 17/00* (2013.01); *G09F 21/02* (2013.01); *G09F 2017/005* (2013.01)

(58) Field of Classification Search
CPC ..... A41D 15/04; G09F 17/00; G09F 17/0041; G09F 2017/005; G09F 21/00; G09F 21/02; G09F 21/023; G09F 21/026
USPC ..... 116/173, 174; 40/586; 2/1, 69, 209.13
See application file for complete search history.

(56) References Cited

U.S. PATENT DOCUMENTS 2,971,198 A * 2/1961 Tomich ..... A41D 3/08 2/84
3,042,940 A * 7/1962 Keaton ..... A47C 7/021 116/173
3,590,864 A * 7/1971 Vechesloff ..... A41D 15/04 135/115
3,797,043 A * 3/1974 Brument ..... A45F 4/02 2/69.5
3,818,158 A * 6/1974 Nakanishi ..... A41D 15/04 2/202
4,476,587 A * 10/1984 Itoi ..... A41D 3/005 2/94
4,752,971 A * 6/1988 Meserol ..... A41D 3/08 2/84

(Continued)

FOREIGN PATENT DOCUMENTS

GB 2293094 A * 3/1996 ..... A41D 7/008
JP 3105616 U 11/2004

OTHER PUBLICATIONS

The English machine translation for JP 3105616 U as taken from PCT/US16/021931, dated May 16, 2016, three pages.*

(Continued)

*Primary Examiner* — R. A. Smith
(74) *Attorney, Agent, or Firm* — Acker Wood IP Law LLC; Gwen R. Acker Wood

(57) ABSTRACT

A multipurpose memento is provided. The multipurpose memento includes a body made of a woven fabric material. The body includes an upper edge, a lower edge opposite the upper edge, a first side edge and a second side edge opposite the first side edge. The body may be in the shape of a rectangle. A first sleeve is formed along the first side edge and a second sleeve is formed along the upper edge. A post may fit within either the first sleeve or the second sleeve, allowing the present invention the use as a crowd friendly flag/banner and to convert from a flag to a banner.

16 Claims, 4 Drawing Sheets

(56) References Cited

U.S. PATENT DOCUMENTS

| | | | | | |
|---|---|---|---|---|---|
| 4,944,042 | A * | 7/1990 | Dewan | A41D 15/04 | 190/1 |
| 5,179,907 | A * | 1/1993 | Galbraith | G09F 17/00 | 116/173 |
| 5,400,437 | A * | 3/1995 | Koutras | A41D 15/04 | 116/173 |
| 5,617,584 | A * | 4/1997 | Brennan | A41D 13/11 | 2/172 |
| 6,708,343 | B1 * | 3/2004 | Ceron | A41D 3/08 | 2/84 |
| 7,017,512 | B2 * | 3/2006 | Laird et al. | G09F 17/00 | 116/173 |
| 8,776,714 | B1 * | 7/2014 | Delaney, Jr. | G09F 17/00 | 116/173 |
| 8,832,868 | B2 * | 9/2014 | Owen | A41D 27/08 | 2/244 |
| 9,187,214 | B2 * | 11/2015 | Brunger | A45C 9/00 | |
| D787,369 | S * | 5/2017 | Held | D11/165 | |
| D818,390 | S * | 5/2018 | Held | D11/165 | |
| 2005/0039242 | A1 | 2/2005 | Edmondson | | |
| 2007/0006498 | A1 | 1/2007 | Collins | | |
| 2007/0083983 | A1 * | 4/2007 | Barclay | A41D 3/00 | 2/227 |
| 2011/0290683 | A1 | 12/2011 | High et al. | | |
| 2014/0090282 | A1 | 4/2014 | Sedliacik | | |
| 2016/0353816 | A1 * | 12/2016 | Strace | A41D 15/04 | |

OTHER PUBLICATIONS

International Search Report and Written Opinion for PCT/US2016/021931 dated May 16, 2016, 10 pages.

* cited by examiner

MULTIPURPOSE FABRIC MEMENTO

CROSS-REFERENCE TO RELATED APPLICATION

This application claims the benefit of priority of U.S. provisional application No. 62/133,019, filed Mar. 13, 2015, the contents of which are herein incorporated by reference.

BACKGROUND OF THE INVENTION

The present invention relates to a multipurpose memento and, more particularly, to a multipurpose flag for displaying an event design.

A flag is a piece of fabric (most often rectangular or quadrilateral) with a distinctive design that is used as a symbol, as a signaling device, or as decoration. A banner is a flag or other piece of cloth bearing a symbol, logo, slogan or other message. Currently, decorative flags may include names and/or logos of music bands, sports teams, schools, companies, and the like. Typically decorative flags are either purchased or passed out at events. However, flags have a limited lifespan, are difficult to display and consequently become a memento that is stored away or thrown away. They lack the means to become multi-functional.

As can be seen, there is a need for a fabric memento that may be worn and displayed in multiple configurations.

SUMMARY OF THE INVENTION

In one aspect of the present invention, a multipurpose memento comprises: a body comprising a fabric material having an upper edge, a lower edge opposite the upper edge, and at least a first side edge; a first sleeve formed along the first side edge; and a second sleeve separate from the first sleeve and formed along the upper edge.

In another aspect of the present invention, a multipurpose memento comprises: a body comprising a fabric material having an upper edge, a lower edge opposite the upper edge, and at least a first side edge; a first sleeve formed along the first side edge; and a second sleeve formed along the upper edge, wherein the first sleeve and the second sleeve are substantially perpendicular relative to one another.

In another embodiment, methods of using a multipurpose memento are presented including: providing a multipurpose memento, the multipurpose memento including, a body including a fabric material having an upper edge, a lower edge opposite the upper edge, and at least a first side edge; a first sleeve formed along the first side edge; a second sleeve formed along the upper edge, where the first sleeve and the second sleeve are substantially perpendicular relative to one another; at least one cord secured to the body, where the at least one cord is disposed in between the first side edge and the upper edge; a draw cord tensioner attached to the at least one cord; folding the multipurpose memento in accordance with a number of printed instructions disposed along a back surface of the first sleeve, where the number of printed instructions display directions for a number of uses for the multipurpose memento along a back surface of the first sleeve, and where the uses are selected from the group consisting of: a flag, a banner, a doo-rag, a backpack accessory, belt loop accessory, a scarf, a tote bag, a face mask, a head band, a leg warmer, an arm warmer, and a cape; and displaying the multipurpose memento.

These and other features, aspects and advantages of the present invention will become better understood with reference to the following drawings, description and claims.

DETAILED DESCRIPTION OF THE INVENTION

Figure 1:
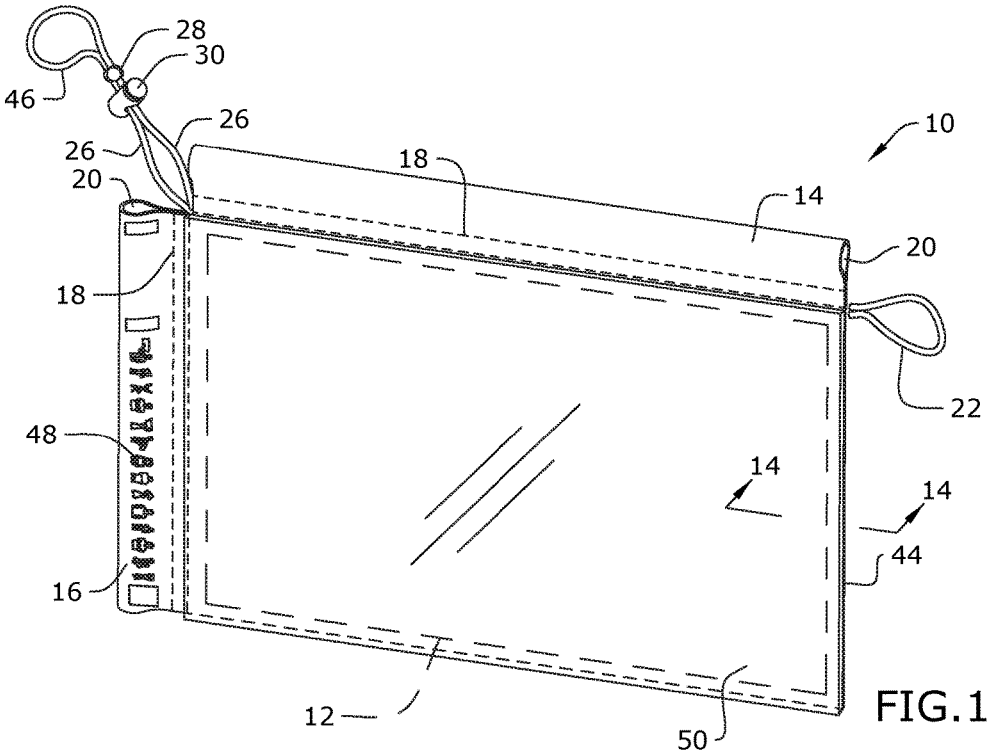
FIG. 1 is a front perspective view of an embodiment of the present invention.
Figure 2:
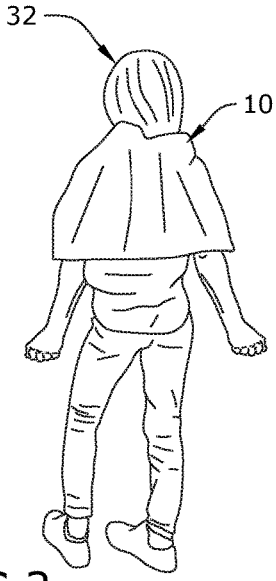
FIG. 2 is a perspective view of an embodiment of the present invention used as a cape.
Figure 3:
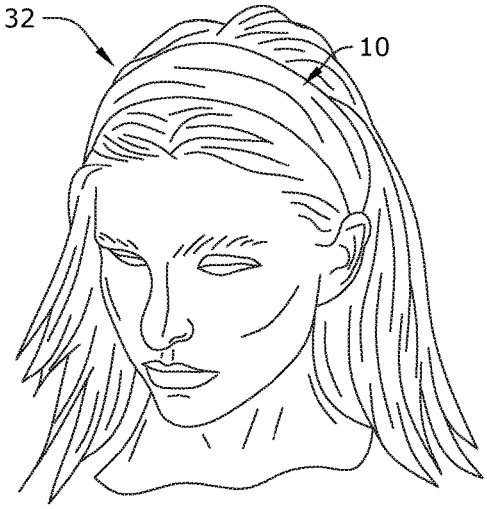
FIG. 3 is a perspective view of an embodiment of the present invention used as a headband.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a collectible that resembles a flag but includes multiple uses. The present invention includes a body resembling a flag with a first sleeve and a second sleeve running along its edge. A post may fit through the sleeves, turning the present invention instantly into either a banner or flag. The present invention further includes cords allowing for different configurations. The present invention may include printed logos and names on either the front or rear surfaces.

The present invention may be used with or without a post, and thereby may be considered safe and crowd friendly. When used without a post, the present invention may be used as a hand flag—held high in a crowd using the wrist attachment and thumb loop, it may also be worn as a doo-rag, a scarf, a cape or can be an attachment, to backpack or pants belt loop, and subsequently when the event is over it can be displayed on the wall using the top sleeve. Since the present invention may be used in multiple configurations, the present invention is much more useful than a regular flag as we know one and is the ultimate memento for an event.

Referring to FIGS. 1 through 15, the present invention includes a multipurpose memento 10. The multipurpose memento 10 includes a body 44 made of a fabric material. The body 44 includes an upper edge, a lower edge opposite the upper edge, a first side edge and a second side edge opposite the first side edge. The body 44 may be in the shape of a rectangle. A first sleeve 16 is formed along the first side edge and a second sleeve 14 is formed along the upper edge. A post 24 may fit within either the first sleeve 16 or the second sleeve 14, allowing the present invention to convert from a flag to a banner effortlessly.

As mentioned above, the body 44 of the present invention may be made of a fabric material, such as a woven fabric material. The fabric material may include any natural or synthetic fibers, such as, but not limited to, cotton, polyester, nylon, satin, silk, or a combination thereof and the like. In certain embodiments, the woven fabric material may be made of glow in the dark material or include glow in the dark sections, allowing the present invention to be seen at night. The body 44 may include a front surface and a rear surface. A design or text 12 may be printed on the front and/or rear surface of the body 44 to be displayed. The design or text 12 may be printed by digital printing, sublimation or other similar methods. The size of the body 44 may vary. In certain embodiments, the size of the body 44 may be about 30 cm.times.45 cm. In certain embodiments, the body 44 may be formed of two sheets sewn together, forming a pocket in between with an opening forming an entrance. In such embodiments, the present invention may be used as a tote bag. In other such embodiments, one of the two sheets may be a transparent sheet 50 coupled along the front surface of the body where the transparent sheet 50 and the front surface of the body form a pocket for receiving an insert.

The first sleeve 16 may be vertically disposed, while the second sleeve 14 may be horizontally disposed. The first sleeve 16 and the second sleeve 14 are separate from one another and may be substantially perpendicular relative to one another. The sleeves 14, 16 each include an internal tube 20 having an entrance opening leading into the sleeve 14, 16 and an exit opening leading out of the sleeve 14, 16. The sleeves 14, 16 may be formed by stitching 18 or may be coupled with body by any other method known in the art without departing from embodiments provided herein. For example, the upper edge may be folded over on itself and stitched to the body 44 by stitching 18, forming the internal tube 20 in between. The first side edge may be folded over on itself and stitched or otherwise coupled with the body 44, forming the internal tube 20 in between.

The present invention may further include at least one cord 22, 26 secured to the body 44. The at least one cord 22, 26 may be an elastic cord. In certain embodiments, the at least one cord 22, 26 is secured in between the first side edge and the upper edge. The cord 22, 26 may be used to secure the body 44 to the post 24 forming a flag. In such embodiments, the cord 22, 26 may include ties, a hook and loop fastener, a draw cord tensioner 30 and the like. When the draw cord tensioner 30 is in use, the cord 22, 26 may be looped and may be adjustably sized by draw cord tensioner 30. The looped cord 22, 26 may further include a tie 28 or draw cord tensioner tying off a portion 46 of the cord 22, 26. The cord 22, 26 may fit around the post 24 and the draw cord tensioner 30 may be tightened against the post 24, thereby securing the body 44 to the post 24. Further, the cord 22, 26 may be used to secure to a user's wrist, thumb, backpack 34 and belt loop 40.

In certain embodiments, the at least one cord 22, 26 may include a first cord 22 and a second cord 26. The first cord 22 may be attached in between the first side edge and the upper edge and the second cord 26 may be attached in between the upper edge and the second side edge. The first cord 22 and second cords 26 may each include loops. In certain embodiments, the first cord 22 forms a larger loop than the second cord 26. The first cord 22 may be used as a wrist band and the second cord 26 may be used as a thumb loop for holding the body 44 up during a concert or other event. Further, the first cord 22 and the second cord 26 allow the present invention to be used as a scarf, a doo-rag, a cape, a face mask, a head band, a leg or arm warmer and the like, in which the body 44 is wrapped around and the first cord 22 and the second cord 26 are tied together.

The post 24 of the present invention may be a conventional wooden flag post with a ball at a top end. In other embodiments, posts may include: a metal tube, a metal shaft, a non-metal tube, a non-metal shaft, a polymeric tube, and a polymeric shaft. Alternatively, the present invention may include a collapsible post 42. The collapsible post 42 may be made of a plurality of rolled laminar polymeric sheet manufactured from a polyvinyl chloride formulation sheets nested with each other. For example, seven of the rolled laminar polymeric sheets may be wrapped around one other, forming a post strong enough to support the body 44 and yet pliable enough to deform upon impact. In still other embodiments, the post 24 may be an inflatable tube pressurized to support the multipurpose memento. In other embodiments the post may be constructed from plastic curling material, similar to an elongated slap wrap bracelet. Further, the present invention may utilize a banner post 38 that is secured within the second sleeve 14, which may be mounted to a wall 36, thereby forming a banner.

As mentioned above, the present invention may be used at events. Users 32 may waive the body 44 either using a post 24 or the thumb cord 22. After waiving the present invention as a flag, the user may instantly and easily change the present invention into a banner, a doo-rag, a backpack accessory, belt loop accessory, a scarf, a tote bag, a face mask, a head band, a leg warmer, an arm warmer, and a cape. The present invention may further become a portable poster that can be worn, hung or used as a wall display. Printed instructions, in embodiments, may be strategically disposed along the back surface of the first sleeve 16. Placement of instructions in this position not only provides permanent instructions for a user, but places the instructions in an unobtrusive and unseen location. In embodiments, printed instructions may include a number of pictograms 48 so that any language barrier to use is minimized or eliminated altogether.

Figure 4:
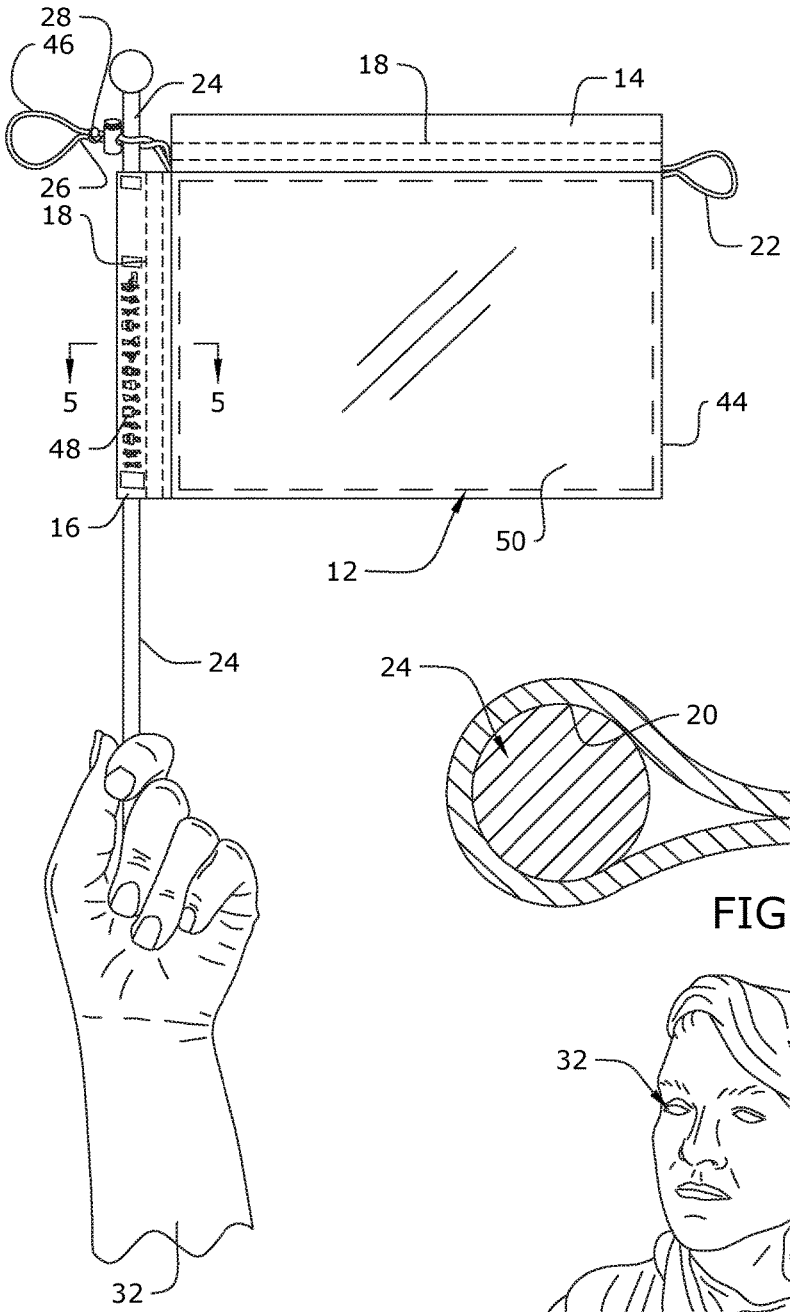
FIG. 4 is a front view of an embodiment of the present invention shown in use as a typical flag.
Figure 6:
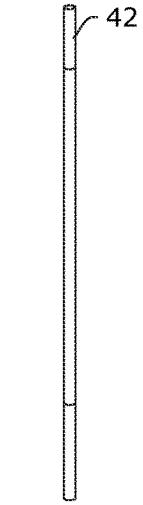
FIG. 6 is a perspective view of an embodiment of an exemplary post of the present invention.
Figure 5:
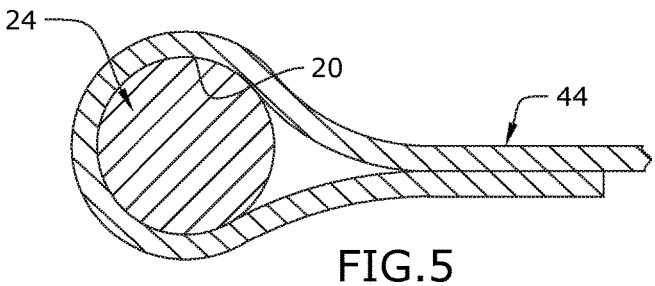
FIG. 5 is a section detail view of the present invention along line 5-5 in FIG. 4.
Figure 7:
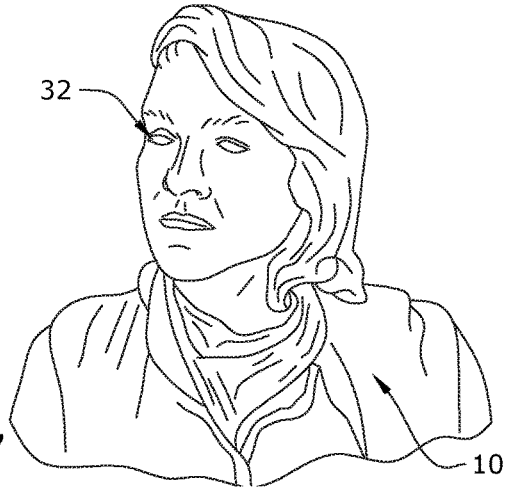
FIG. 7 is a perspective view of an embodiment of the present invention used as an ascot.
Figure 8:
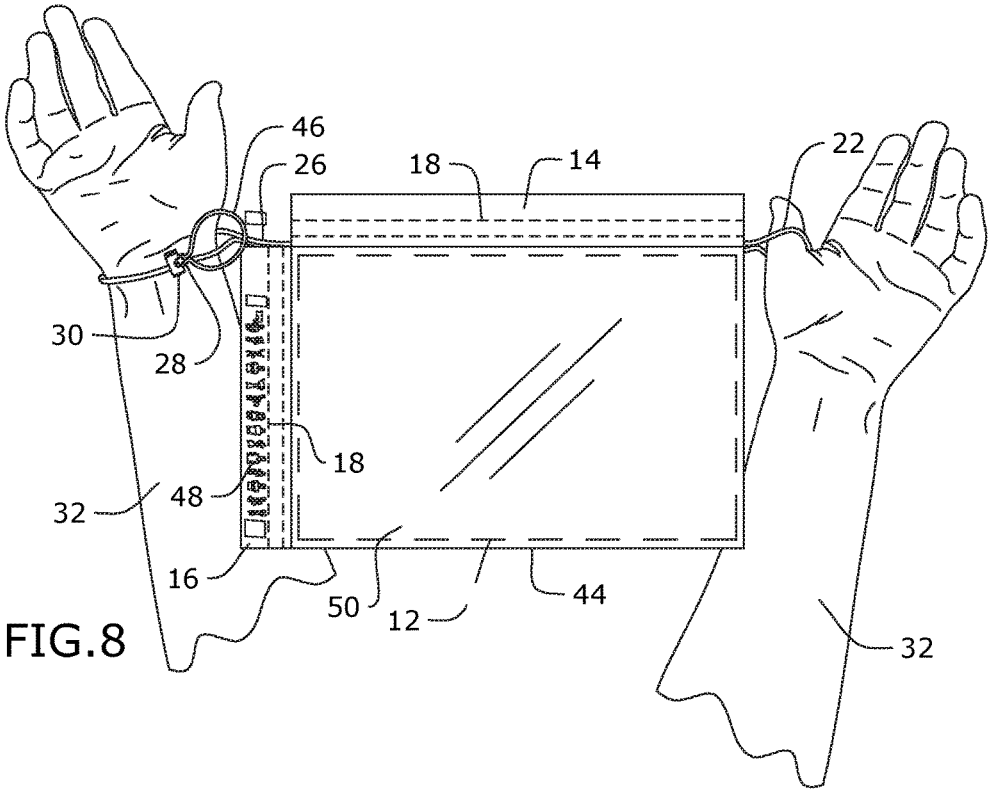
FIG. 8 is a perspective view of an embodiment of the present invention shown used as a banner.
Figure 9:
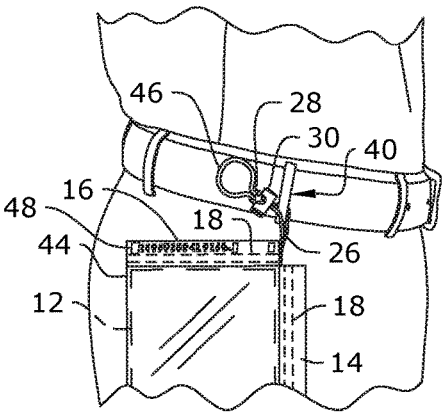
FIG. 9 is a perspective view demonstrating the present invention being displayed on a belt loop.
Figure 10:
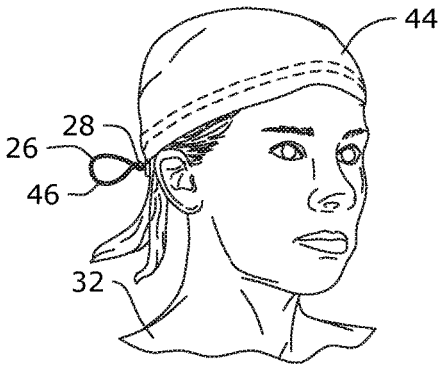
FIG. 10 is a perspective detail view of an embodiment of the present invention shown used as a doo-rag.
Figure 11:
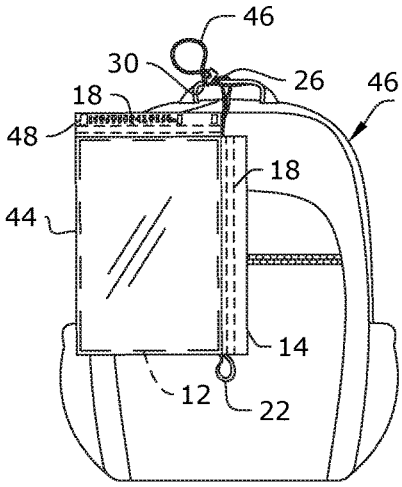
FIG. 11 is a perspective view of an embodiment of the present invention being displayed on a back pack.
Figure 13:
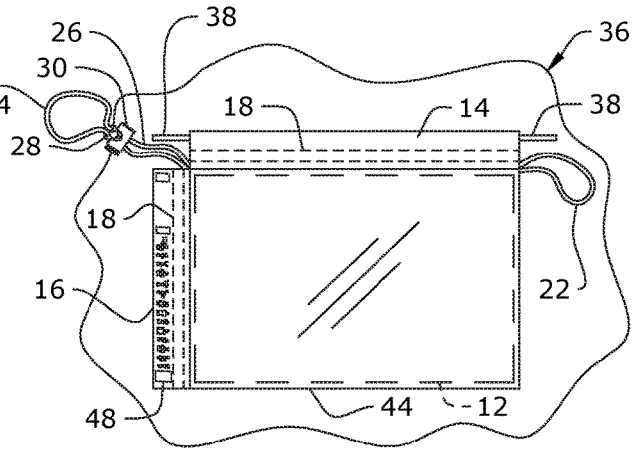
FIG. 13 is a perspective view of an embodiment of the present invention used a banner displayed on a wall
Figure 14:
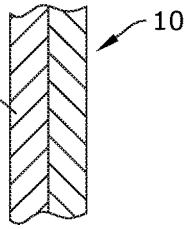
FIG. 14 is a section detail view of the present invention along line 14-14 in FIG. 1.
Figure 12:
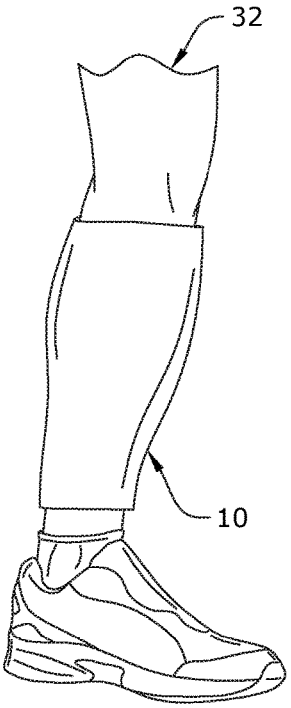
FIG. 12 is a perspective view of an embodiment of the present invention used as a leg warmer.
Figure 15:
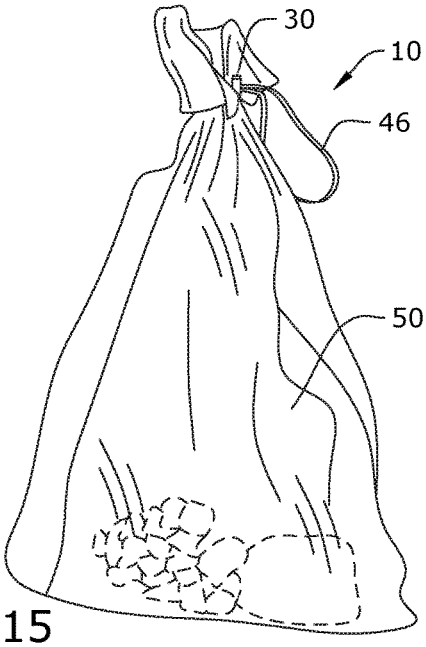
FIG. 15 is a perspective view of the present invention closed as a transparent on one side bag.

In one embodiment illustrated in FIG. 4, multipurpose memento 10 may be used as a flag by inserting post 24 into sleeve 16; securing post 24 with looped cord 22 and draw cord tensioner 30; and displaying multipurpose memento 10. In another embodiment illustrated in FIG. 10, multipurpose memento 10 may be used as a doo-rag by placing multipurpose memento 10 along a user's head; and securing multipurpose memento 10 around the user's head with the draw cord tensioner 30 and another of the at least one draw cords 26, which is attached in between the upper edge and a second side edge opposite the first side edge. In some embodiments, the first sleeve may be folded in such a way to properly display a logo printed thereupon.

It should be understood, of course, that the foregoing relates to exemplary embodiments of the invention and that modifications may be made without departing from the spirit and scope of the invention as set forth in the following claims.

What is claimed is:

1. A multipurpose memento comprising: a body comprising a fabric material having an upper edge, a lower edge opposite the upper edge, a first side edge and a second side edge; a first sleeve formed along the first side edge; a second sleeve separate from the first sleeve and formed along the upper edge, a first cord and a second cord secured to the body, wherein the first cord is attached in between the first side edge and the upper edge and the second cord is attached in between the upper edge and the second side edge; and a draw cord tensioner attached to the first cord, wherein the first cord and the second cord each form a loop, and wherein the draw cord tensioner is configured to adjust a size of the loop of the first cord.

2. The multipurpose memento of claim 1, wherein the body further comprises a second side edge opposite the first side edge, wherein the body is a substantially rectangular shape.

3. The multipurpose memento of claim 1, wherein the first sleeve is formed by the first side edge folded over on itself to form an internal tube and coupled with the body and wherein the second sleeve is formed by the upper edge folded over on itself to form an internal tube and coupled with the body.

4. The multipurpose memento of claim 1, wherein the first sleeve and the second sleeve are substantially perpendicular relative to one another.

5. The multipurpose memento of claim 1, further comprising a post sized to fit within the first sleeve and the second sleeve.

6. The multipurpose memento of claim 5, wherein the post comprises at least one of a wooden stick, a metal tube, a metal shaft, a non-metal tube, a non-metal shaft, a polymeric tube, and a polymeric shaft.

7. The multipurpose memento of claim 5, wherein the post is a collapsible tube.

8. The multipurpose memento of claim 7, wherein the collapsible tube is a rolled laminar polymeric sheet.

9. The multipurpose memento of claim 5, wherein the post is an inflatable tube.

10. The multipurpose memento of claim 1, further comprising: a transparent sheet coupled along a front surface of the body, the transparent sheet and the front surface of the body forming a pocket in between.

11. The multipurpose memento of claim 1, wherein the first sleeve further comprises: a plurality of printed instructions disposed along a back surface of the first sleeve, wherein the plurality of printed instructions display directions for a plurality of uses for the multipurpose memento along a back surface of the first sleeve, and wherein the uses comprise at least two of: a flag, a banner, a doo-rag, a backpack accessory, belt loop accessory, a scarf, a tote bag, a face mask, a head band, a leg warmer, an arm warmer, and a cape.

12. The multipurpose memento of claim 11, wherein the plurality of printed instructions include a plurality of pictograms representative of the uses.

13. A method of using a multipurpose memento comprising: providing the multipurpose memento, the multipurpose memento comprising, a body comprising a fabric material having an upper edge, a lower edge opposite the upper edge, and at least a first side edge; a first sleeve formed along the first side edge; a second sleeve formed along the upper edge, wherein the first sleeve and the second sleeve are substantially perpendicular relative to one another; at least one cord secured to the body, wherein one of the at least one cords is disposed in between the first side edge and the upper edge, said at least one cord forming a loop; a draw cord tensioner attached to the at least one cord disposed in between the first side edge and the upper edge, wherein the draw cord tensioner is configured to adjust size of the loop of the at least one cord disposed in between the first side edge and the upper edge; folding the multipurpose memento in accordance with a plurality of printed instructions disposed along a back surface of the first sleeve, wherein the plurality of printed instructions display directions for a plurality of uses for the multipurpose memento along a back surface of the first sleeve, and wherein the uses are selected from the group consisting of: a flag, a banner, a doo-rag, a backpack accessory, belt loop accessory, a scarf, a tote bag, a face mask, a head band, a leg warmer, an arm warmer, and a cape; and displaying the multipurpose memento.

14. The method of claim 13, wherein the flag use further comprises: inserting a post into the first sleeve or the second sleeve; and securing the multipurpose memento to the post with the draw cord tensioner; and displaying the multipurpose memento.

15. The method of claim 13, wherein the doo-rag use further comprises: placing the multipurpose memento along a user's head; and securing the multipurpose memento around the user's head with the draw cord tensioner and another of the at least one draw cords attached in between the upper edge and a second side edge opposite the first side edge.

16. The method of claim 13, wherein the banner use further comprises: placing the one of the at least one cords around a user's wrist; securing the multipurpose memento around the user's wrist with the draw cord tensioner; and placing another of the at least one draw cords attached in between the upper edge and a second side edge opposite the first side edge on a finger of a user's opposite hand.

* * * * *